US009958245B1

(12) United States Patent
Shih et al.

(10) Patent No.: US 9,958,245 B1
(45) Date of Patent: May 1, 2018

(54) LIQUID DISRUPTOR DEVICE, METHOD OF MANUFACTURING THE SAME, AND LIQUID DISRUPTOR DEVICE MODULE

(71) Applicant: NATIONAL CHUNG SHAN INSTITUTE OF SCIENCE AND TECHNOLOGY, Taoyuan (TW)

(72) Inventors: Chia-Nan Shih, Taoyuan (TW); Hong-Chih Yang, Taoyuan (TW); Lin-Chien Tsai, Taoyuan (TW); Po-Chang Huang, Taoyuan (TW); Guei-Jang Huang, Taoyuan (TW); Min-Han Chiu, Taoyuan (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 0 days. days.

(21) Appl. No.: 15/603,643

(22) Filed: May 24, 2017

(51) Int. Cl.
*F42B 33/06* (2006.01)
*F41B 9/00* (2006.01)

(52) U.S. Cl.
CPC ..... *F42B 33/062* (2013.01); *F41B 9/0046* (2013.01)

(58) Field of Classification Search
CPC ..... F42B 33/062; F41B 9/0046
USPC ..... 86/50; 102/332
See application file for complete search history.

(56) References Cited

U.S. PATENT DOCUMENTS

| | | | | |
|---|---|---|---|---|
| 3,103,882 | A * | 9/1963 | Gilliland | F42B 1/024 102/309 |
| 3,190,219 | A * | 6/1965 | Venghiattis | E21B 43/117 102/306 |
| 4,641,581 | A * | 2/1987 | Weickert | F42B 3/24 102/307 |
| 4,905,601 | A * | 3/1990 | Gabriel | F42B 3/08 102/302 |
| 4,955,939 | A | 9/1990 | Petrousky et al. | |
| 5,134,921 | A | 8/1992 | Breed et al. | |
| 6,269,725 | B1 | 8/2001 | Cherry | |
| 6,584,908 | B2 * | 7/2003 | Alford | F41B 9/0046 102/302 |
| 8,091,479 | B1 | 1/2012 | Jakaboski et al. | |
| 8,677,902 | B1 * | 3/2014 | Rock | F42B 1/028 102/306 |
| 9,429,408 | B1 * | 8/2016 | Chamberlain | F42D 5/04 |

* cited by examiner

*Primary Examiner* — Bret Hayes
(74) *Attorney, Agent, or Firm* — Schmeiser, Olsen & Watts, LLP

(57) ABSTRACT

A liquid disruptor device and a method of manufacturing the same are introduced. The liquid disruptor device comprises a front casing, a liquid seal film, a rear casing, a plane wave generator and a counter-impact cover. The plane wave generator generates a plane blast wave which compresses a liquid contained in the front casing and a liner to not only focus blast energy of the liquid but also allow the liquid to form a liquid knife current for destroying explosives. Hence, the liquid disruptor device displays higher efficiency per unit weight of explosives when detonation thereof occurs at multiple points. Further, a liquid disruptor device module inclusive of at least two liquid disruptor devices combined to assume a geometric shape is introduced.

14 Claims, 6 Drawing Sheets

A-A

200

300

LIQUID DISRUPTOR DEVICE, METHOD OF MANUFACTURING THE SAME, AND LIQUID DISRUPTOR DEVICE MODULE

FIELD OF THE INVENTION

The present invention relates to liquid disruptor devices and, more particularly, to a liquid disruptor device which generates a liquid knife current by plane blast wave.

BACKGROUND OF THE INVENTION

Explosives are usually contained in a casing, and their explosion is triggered by a disruptor mechanism. The explosion is intended to hit a target but is likely to injure human beings and properties in the vicinity of the target. To protect the human beings and properties in the vicinity of the target against the explosion, the prior art mostly involves handling the explosives with a water disruptor device. The water disruptor device works by bombarding water with explosive powder so as to destroy the explosives under the impact of the water. Conventional water disruptor devices fall into two categories: water cannon water disruptor devices and bottle water disruptor devices. A water cannon water disruptor device works in a manner as follows: when the cartridge is set off, the cannon shoots out a concentrated liquid jet which may be used to disable the detonator of an explosive, as disclosed in U.S. Pat. No. 5,134,921. A bottle water disruptor device is provided in the form of a hermetically sealed container filled with water and explosives to achieve the largest explosive surface area under the pressure generated upon explosion, as disclosed in U.S. Pat. No. 6,269,725.

Charles E. Munroe, an American scientist, devised the following: filling a container with explosives; closing the mouth of the container with a conical metal cover whose top faces the inside of the container; and detonating the explosives so that blast energy of the explosives is focused on the top of the conical metal cover to generate a high-speed metallic jet emitted outward in the axial direction of the conical metal cover, thereby allowing a target to be pierced by the metallic jet. The aforesaid phenomenon is known as Munroe effect, wherein the conical metal cover is called a liner. FIG. 9 is a schematic view of the conventional Munroe effect. As shown in FIG. 9, a detonator 71 detonates an explosive 72 and thus generates circular blast waves. The blast waves compress the top of a metal liner 73 and thus focus blast energy of the metal liner 73, thereby generating a metallic jet for piercing a target A.

U.S. Pat. No. 4,955,939 discloses a liquid disruptor device which comprises a non-metallic container filled with explosives and a liquid and coupled to a liner. U.S. Pat. No. 8,091,479 discloses a liquid disruptor device which comprises a liner and a container filled with a liquid. However, the liquid disruptor device disclosed in U.S. Pat. No. 8,091,479 resorts to single-point detonation and thus fails to demonstrate satisfactory efficiency per unit weight of explosives, not to mention that the efficacy of the liquid disruptor device in operation is restricted to one-dimensional destruction of a target. Therefore, it is important to enhance a liquid disruptor device's efficiency per unit weight of explosives, increase the area of destruction inflicted on a target, and create larger destructive openings on the target.

SUMMARY OF THE INVENTION

In view of the aforesaid drawbacks of the prior art, it is an objective of the present invention to provide a liquid disruptor device which comprises a front casing, a liquid seal film, a rear casing, a plane wave generator and a counter-impact cover.

The front casing comprises a liner, an enclosing wall, a front casing chamber and a front casing opening. The liner is formed by bending an upright plate lengthwise, backward. The enclosing wall is formed by extending an edge of the liner backward by a distance. The front casing chamber is defined by the liner and the enclosing wall. The front casing chamber contains a liquid. The front casing opening is in communication with the outside of the front casing and the front casing chamber.

The liquid seal film closes the front casing opening of the front casing.

The rear casing is coupled to the front casing from behind. The rear casing comprises an outer casing wall, an outer casing wall chamber, an outer casing wall opening, an inner casing wall, an inner casing wall chamber and an inner casing wall opening. The outer casing wall chamber is defined by the outer casing wall. The outer casing wall chamber contains explosives and blowback weights. The outer casing wall opening is in communication with the outside of the rear casing and the outer casing wall chamber. The inner casing wall is disposed in the outer casing wall chamber. The inner casing wall chamber is defined by the inner casing wall. A detonator can be inserted into the inner casing wall chamber. The inner casing wall opening is in communication with the outside of the rear casing and the inner casing wall chamber.

The plane wave generator is disposed between the front casing and the rear casing. The plane wave generator comprises a plate. The plate has a plate surface and a groove. The groove is disposed on the plate surface. The groove contains explosives.

The counter-impact cover comprises a lid and a through hole. The lid closes the outer casing wall opening of the rear casing to reduce the impact of the explosives. The through hole is formed on the lid to penetrate the lid. The through hole corresponds in position to the inner casing wall opening of the rear casing Regarding the liquid disruptor device, the front casing, the liquid seal film, the rear casing, the plane wave generator and the counter-impact cover are made of a flexible material.

Regarding the liquid disruptor device, a cross section attributed to the liner and perpendicular to a lengthwise direction of the liner is of a tall V-shape.

Regarding the liquid disruptor device, a cross section of the liquid disruptor device is of a specific radially-extending-shape and is defined by at least three arms.

Regarding the liquid disruptor device, included angles between the arms are variable.

In order to achieve the above and other objectives, the present invention provides a method of manufacturing a liquid disruptor device, comprising the steps of:

(a) providing a front casing, the front casing comprising: a liner formed by bending an upright plate lengthwise, backward; an enclosing wall formed by extending an edge of the liner backward by a distance; a front casing chamber defined by the liner and the enclosing wall; and a front casing opening in communication with an outside of the front casing and the front casing chamber;

(b) introducing a liquid into the front casing chamber of the front casing;

(c) providing a liquid seal film, followed by closing the front casing opening of the front casing with the liquid seal film;

(d) providing a plane wave generator, the plane wave generator comprising a plate having a plate surface and a groove, with the groove formed on the plate surface;

(e) placing explosives in the groove of the plane wave generator, following by placing the plane wave generator behind the front casing;

(f) providing a rear casing, the rear casing comprising an outer casing wall, an outer casing wall chamber, an outer casing wall opening, an inner casing wall, an inner casing wall chamber, and an inner casing wall opening, the outer casing wall chamber being defined by the outer casing wall, the outer casing wall opening being in communication with the outside of the rear casing and the outer casing wall chamber, the inner casing wall being disposed in the outer casing wall chamber, the inner casing wall chamber being defined by the inner casing wall, and the inner casing wall opening being in communication with the outside of the rear casing and the inner casing wall chamber;

(g) placing the explosives and blowback weights in the outer casing wall chamber of the rear casing;

(h) providing a counter-impact cover, the counter-impact cover comprising a lid and a through hole, with the through hole formed on the lid to penetrate the lid;

(i) closing the outer casing wall opening of the rear casing with the lid of the counter-impact cover so that the through hole of the counter-impact cover corresponds in position to the inner casing wall opening of the rear casing;

(j) coupling the rear casing to the front casing from behind so that the plane wave generator is disposed between the front casing and the rear casing; and (k) inserting a detonator into the inner casing wall chamber of the rear casing.

Regarding the method, a cross section attributed to the liner and perpendicular to a lengthwise direction of the liner is of a tall V-shape.

Regarding the method, a cross section of the liquid disruptor device is of a specific radially-extending-shape and is defined by at least three arms.

Regarding the method, included angles between the arms are variable.

In order to achieve the above and other objectives, the present invention further provides a liquid disruptor device module which comprises at least two said liquid disruptor devices.

Regarding the liquid disruptor device module, the liquid disruptor devices combine and thereby take on a geometric shape.

The liquid disruptor device, the method of manufacturing the same, and the liquid disruptor device module together achieve higher efficiency per unit weight of explosives when detonation thereof occurs at multiple points so that the efficacy of the liquid disruptor device in operation is not restricted to one-dimensional destruction of a target, thereby inflicting a large are of destruction to the target and creating larger destructive openings on the target.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
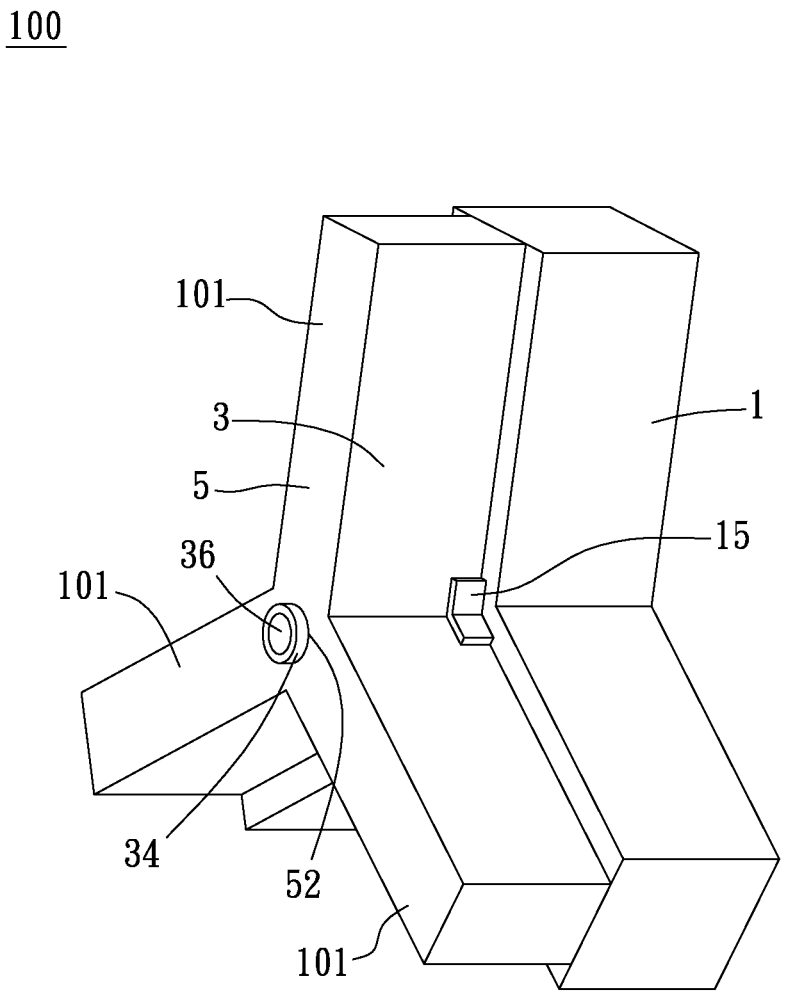
FIG. 1 is a perspective view of a liquid disruptor device according to the first embodiment of the present invention.
Figure 2:
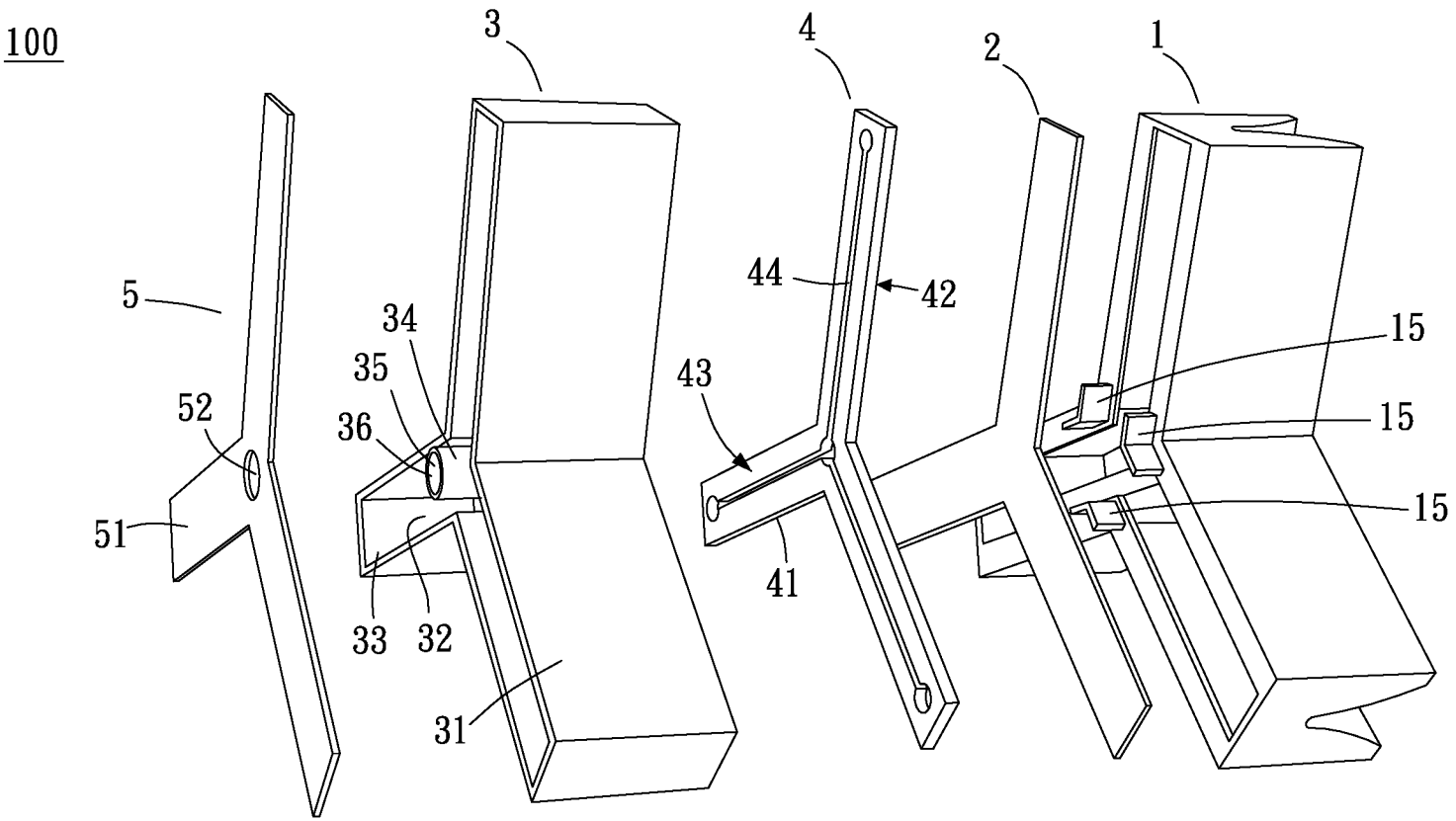
FIG. 2 is an exploded view of the liquid disruptor device according to the first embodiment of the present invention.

The first embodiment of the present invention provides a liquid disruptor device 100 shown in FIGS. 1-6. Referring to FIGS. 1, 2, the liquid disruptor device 100 comprises a front casing 1, a liquid seal film 2, a rear casing 3, a plane wave generator 4 and a counter-impact cover 5.

Figure 3:
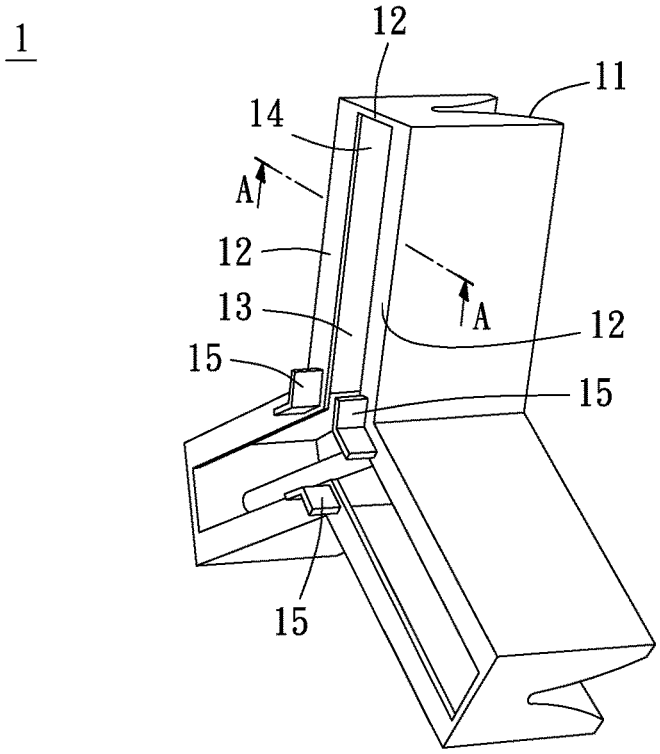
FIG. 3 is a partial schematic view of the liquid disruptor device according to the first embodiment of the present invention.
Figure 4:
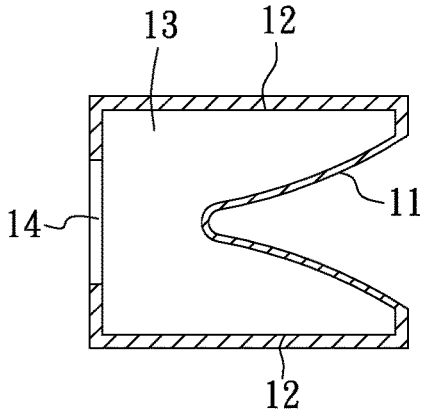
FIG. 4 is a partial cross-sectional view of the liquid disruptor device taken along line A-A according to the first embodiment of the present invention.

Referring to FIGS. 3, 4, the front casing 1 comprises a liner 11, an enclosing wall 12, a front casing chamber 13 and a front casing opening 14. The liner 11 is formed by bending an upright plate lengthwise, backward. The enclosing wall 12 is formed by extending the edge of the liner 11 backward by a distance. The front casing chamber 13 is defined by the liner 11 and the enclosing wall 12. The front casing chamber 13 contains a liquid. The front casing opening 14 is in communication with the outside of the front casing 1 and the front casing chamber 13.

Referring to FIGS. 1, 2, the liquid seal film 2 closes the front casing opening 14 of the front casing 1 to prevent the leakage of the liquid from the front casing 1. The rear casing 3 is coupled to the front casing 1 from behind and separated from the front casing 1 by a gap (not shown). The rear casing 3 comprises an outer casing wall 31, an outer casing wall chamber 32, an outer casing wall opening 33, an inner casing wall 34, an inner casing wall chamber 35 and an inner casing wall opening 36. The outer casing wall chamber 32 is defined by the outer casing wall 31. The outer casing wall chamber 32 contains explosives and blowback weights. The explosives are disposed in the front half of the outer casing wall chamber 32. The blowback weights are disposed in the rear half of the outer casing wall chamber 32. The outer casing wall opening 33 is in communication with the outside of the rear casing 3 and the outer casing wall chamber 32. The inner casing wall 34 is disposed in the outer casing wall chamber 32. The inner casing wall chamber 35 is defined by the inner casing wall 34 and adapted to receive a detonator. The inner casing wall opening 36 is in communication with the outside of the rear casing 3 and the inner casing wall chamber 35.

The plane wave generator 4, a plate of a specific thickness, is disposed in the gap between the rear casing 3 and the front casing 1. The plane wave generator 4 comprises a plate 41. The plate 41 has a front plate surface 42, a rear plate surface 43 and a groove 44. The front plate surface 42 faces the liquid seal film 2. The rear plate surface 43 faces the rear casing 3. The groove 44 is formed on the rear plate surface 43. The groove 44 contains explosives.

The counter-impact cover 5 comprises a lid 51 and a through hole 52. The lid 51 closes the outer casing wall opening 33 of the rear casing 3 and thereby reduces the force of explosion of the explosives in the rear casing 3. The through hole 52 is formed on the lid 51 to penetrate the lid 51. The through hole 52 corresponds in position to the inner casing wall opening 36 of the rear casing 3 to allow the detonator to be inserted into the rear casing 3 without being blocked by the lid 51. In this embodiment, one end of the inner casing wall 34 is positioned proximate to the inner casing wall opening 36 and designed to protrude from the through hole 52 slightly.

The liquid disruptor device 100 for use in detonating explosives is manufactured in the steps as follows: providing the front casing 1, introducing a liquid into the front casing chamber 13 of the front casing 1; closing the front casing opening 14 of the front casing 1 with the liquid seal film 2 to prevent leakage of the liquid from the front casing 1, wherein the seal film is provided in the form of a hot-press seal film or an adhesive seal film; placing the explosives in the groove 44 of the plane wave generator 4 before placing the plane wave generator 4 behind the front casing 1; filling the front half of the outer casing wall chamber 32 of the rear casing 3 with the explosives before filling the rear half of the outer casing wall chamber 32 with blowback weights; coupling the counter-impact cover 5 to the rear casing 3 from behind so that the lid 51 of the counter-impact cover 5 closes the outer casing wall opening 33 of the rear casing 3 in a manner to allow the through hole 52 of the counter-impact cover 5 to correspond in position to the inner casing wall opening 36 of the rear casing 3 (one end of the inner casing wall 34 is positioned proximate to the inner casing wall opening 36 and protrudes the through hole 52, and the coupling of the counter-impact cover 5 and the rear casing 3 is achieved by a mortise and tenon joint or by an adhesive); coupling the rear casing 3 to the front casing 1 from behind so that the plane wave generator 4 is disposed between the front casing 1 and the rear casing 3 (the coupling of the rear casing 3 and the front casing 1 is achieved by a mortise and tenon joint or by an adhesive); and inserting a detonator into the inner casing wall chamber 36 of the rear casing 3.

Figure 5:
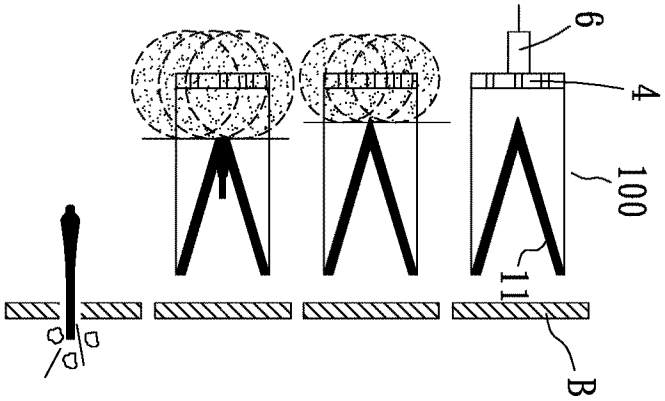
FIG. 5 is a schematic view of how the liquid disruptor device performs liquid detonation on explosives according to the first embodiment of the present invention.

FIG. 5 is a schematic view of how the liquid disruptor device 100 performs liquid detonation on explosives according to the first embodiment of the present invention. As shown in FIG. 5, the liquid disruptor device 100 is in place several centimeters from explosives B, or is attached to the explosives B as needed. Then, detonation of the liquid disruptor device 100 with a detonator 6 inserted therein occurs, followed by propagation of the blast wave of the explosion to the plane wave generator 4. Contained in the groove 44 of the plane wave generator 4, the explosives explode to thereby scatter across a plane rather than stick to a single point. The detonator 6 detonates the explosives in a manner to bring about multiple initiation points at which the explosives in the rear casing 3 explode, respectively. Hence, the explosion of the explosives in the liquid disruptor device 100 occurs at multiple points. Circular blast waves are generated at the multiple points, respectively, and then the circular blast waves join each other to form a plane blast wave. The plane blast wave compresses the liner 11 and the liquid inside the front casing 1. When compressed, the liquid inside the front casing 1 is energized to form a liquid knife current to be emitted outward. The emitted liquid knife current penetrates the explosives B, thereby effectuating liquid detonation of the explosives. Unlike a circular blast wave generated at a single point, the aforesaid plane blast wave not only compresses the liquid and the liner 11 harder, but also increases the energy gathered by the liquid knife current to thereby enable the liquid knife current generate to be more destructive. Hence, the liquid disruptor device 100 displays higher efficiency per unit weight of explosives when detonation of the explosives is carried out at multiple points than a single point. The blowback weights and the counter-impact cover 5 not only resist the impact of the plane blast wave compressing the liquid and the liner 11 but also generate a reaction force. Furthermore, the liquid inside the liquid disruptor device 100 is introduced into the front casing 1 beforehand and hermetically sealed with the liquid seal film 2, sparing workers the hassles of performing on-site operations.

Depending on user needs, the liquid disruptor device 100 is open to variety of shapes. For example, a cross section perpendicular to the lengthwise direction of the inner casing wall chamber 35 and attributed to the liquid disruptor device 100 is slender (not shown) or V-shaped (not shown). Referring to FIGS. 1, 2, in the first embodiment, a cross section perpendicular to the lengthwise direction of the inner casing wall chamber 35 and attributed to the liquid disruptor device 100 is defined by three arms 101 in a manner to allow the cross section to be radially-extending-shaped as described below. The three arms 101 meet at a point corresponding in position to the inner casing wall chamber 35 and extend, radially outward from the point. In practice, the arms 101 are in the number of at least three, such as four, five, or more. Hence, the liquid knife current emitted from the front casing 1, which is radially-extending-shaped, are thus distributed in a radially-extending-shaped pattern as soon as the explosives in the liquid disruptor device 100 are detonated. Likewise, the explosives crack in a radially-extending-shaped pattern when penetrated by the liquid knife current. Deprived of planar structural support, the radially-extending-shaped cracks keep enlarging and deforming because of the progressively destructive liquid knife current. Given the same weight of explosives in use, a two-dimensional, radially-extending-shaped liquid knife current is more destructive to the explosives than a one-dimensional, linear liquid knife current; hence, the radially-extending-shaped liquid disruptor device 100 displays higher efficiency per unit weight of explosives.

Referring to FIGS. 3, 4, the cross section attributed to the liner 11 and perpendicular to a lengthwise direction of the liner 11 is of a tall V-shape conducive to further enhancement of the focusing of blast energy of the liquid.

The front casing 1, the liquid seal film 2, the rear casing 3, the plane wave generator 4 and the counter-impact cover 5 are made of a flexible material so that the liquid disruptor device 100 displays flexibility. The flexible material can be rubber, styrene rubber, silicon rubber, or fluochloride rubber, provided that it does not react with the liquid in the liquid disruptor device 100. A liquid disruptor device made of a material which lacks ductility but demonstrates rigidity proves clumsy in fitting around explosives of cylindrical, spherical or irregular shapes and thus requires another fixing device for holding the liquid disruptor device and the explosives together. By contrast, the liquid disruptor device 100 of the present invention is made of a flexible material and thus can fit tightly round the explosives.

Figure 6:
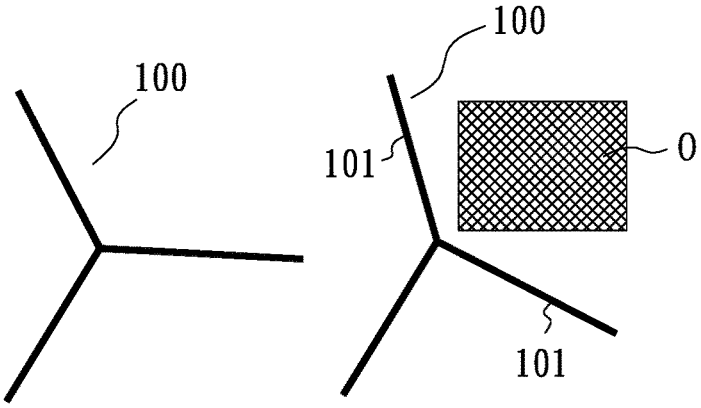
FIG. 6 is a schematic view of operation of the liquid disruptor device according to the first embodiment of the present invention.

Referring to FIG. 6, the flexibility of the liquid disruptor device 100 contributes to variability of included angles between the arms 101 of the liquid disruptor device 100. For example, in event of an obstacle O put in the way of the liquid disruptor device 100, one of the arms 101 can be pulled away from another one of the arms 101 to increase the included angle therebetween, thereby allowing the liquid disruptor device 100 to go around the obstacle O.

Referring to FIG. 1 through FIG. 3, three positioning blocks 15 are disposed at the front casing 1 and positioned proximate to the front casing opening 14 but distal to the liner 11. The positioning blocks 15 fix the rear casing 3 and the plane wave generator 4 in place so as for the rear casing 3 and the plane wave generator 4 to be coupled to the front casing 1.

In this embodiment, the liquid introduced into the liquid disruptor device 100 is water, but the present invention is not limited thereto; hence, a fluid can be introduced into the liquid disruptor device 100, provided that the fluid is compressible and thus able to have its blast energy focused by the blast waves generated as a result of the explosion of the explosives. Examples of the fluid include a Newtonian fluid and a non-Newtonian fluid. Exemplified by water, the Newtonian fluid is characterized in that its stress is linearly proportional to its strain rate. Exemplified by a slurry, the non-Newtonian fluid is characterized by a non-linear relationship of stress and strain rate. The blowback weights contained in the liquid disruptor device 100 are not flammable, such as water, sand, and dry-powder fire-extinguishing agent.

In the first embodiment, at least two liquid disruptor devices 100 are joined to form a liquid disruptor device module of a specific geometric shape as needed in a manner as follows: connecting at least one of the arms 101 of each liquid disruptor device 100 to one of the arms 101 of another liquid disruptor device 100.

Figure 7:
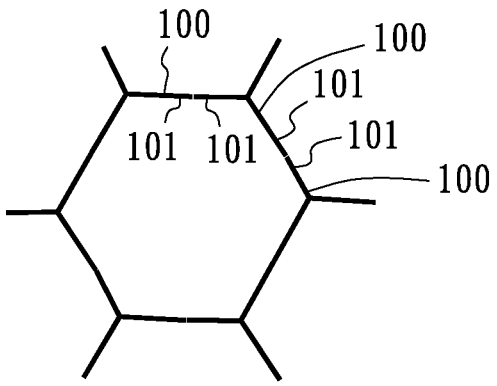
FIG. 7 is a schematic view of the liquid disruptor device according to the second embodiment of the present invention.

Referring to FIG. 7, the second embodiment of the present invention provides a liquid disruptor device module 200. The liquid disruptor device module 200 comprises six liquid disruptor devices 100. When two of the arms 101 of each liquid disruptor device 100 connect with one of the arms 101 of each of the two other liquid disruptor devices 100, the liquid disruptor devices 100 together form the hexagonal liquid disruptor device module 200. To detonate large explosives with the hexagonal liquid disruptor device module 200 and facilitate the release of pressure at the end of the detonation of the explosives, it is necessary to cause large hexagonal cracks to the surfaces of the explosives.

Figure 8:
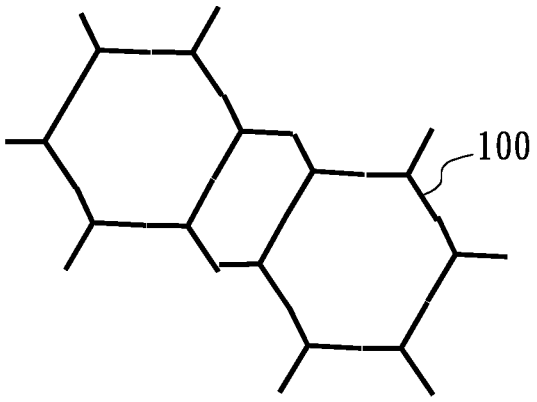
FIG. 8 is a schematic view of the liquid disruptor device according to the third embodiment of the present invention.
Figure 9:
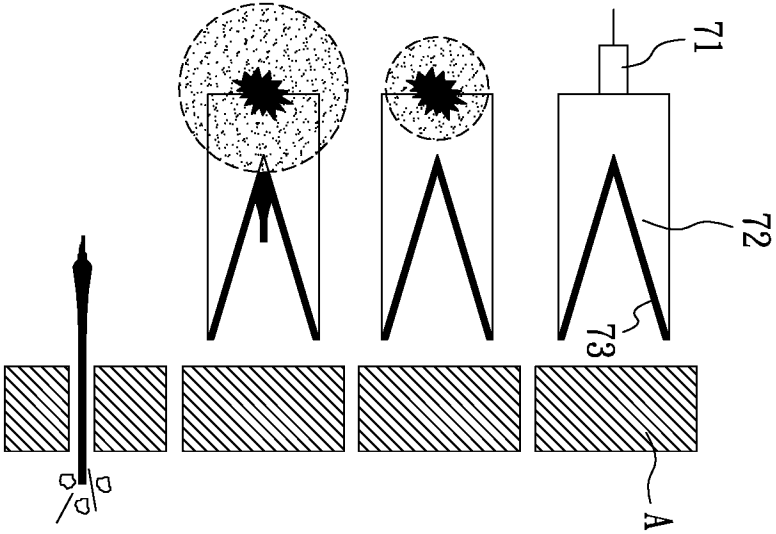
(PRIOR ART) FIG. 9
FIG. 9 (PRIOR ART) is a schematic view of the conventional Munroe effect.

Referring to FIG. 8, the third embodiment of the present invention provides a liquid disruptor device module 300. The liquid disruptor device module 300 comprises twelve liquid disruptor devices 100. The third embodiment is identical to the second embodiment in terms of how to form the liquid disruptor device module 300 from the liquid disruptor devices 100. The liquid disruptor device module 300 is substantially elliptical-ring-shaped. If a closed space within a building catches fire or a ship capsizes, rescuers can hit, to form a large opening on, the wall of the building or the hull of the ship with the liquid disruptor device module 300, enabling residents' and passengers' escape.

The plane wave generator 4 triggers multi-point explosions to generate a plane blast wave. The plane blast wave compresses the liquid and the liner 11 and thereby focuses blast energy of the liquid. The focusing of blast energy of the liquid compressed by the plane blast wave is stronger than the focusing of blast energy of the liquid compressed by the circular blast waves; hence, the plane blast wave enables the liquid knife current to be more destructive. The cracks on the surfaces of the explosives are radially-extending-shaped as a result of the penetration of the radially-extending-shaped liquid knife current generated from the radially-extending-shaped liquid disruptor device 100 into the explosives. Deprived of planar structural support, the radially-extending-shaped cracks keep enlarging and deforming because of the progressively destructive liquid knife current. Given the same weight of explosives in use, the liquid disruptor device 100 renders the explosives more destructive and displays optimal efficiency per unit weight of explosives. Unlike the liquid disruptor device 100, conventional liquid disruptor devices display low efficiency per unit weight of explosives, because the efficacy of conventional liquid disruptor devices in operation is restricted to one-dimensional destruction of a target, thereby failing to create larger destructive openings on the target. Furthermore, concern with safety necessitates a reduction in the required amount of explosives in operation in cities where explosives always abound. Since the liquid disruptor device 100 displays higher efficiency per unit weight of explosives than conventional liquid disruptor devices, the liquid disruptor device 100 is capable of detonating a small amount of explosives and thus decreasing unexpected damage done to human beings and properties in the vicinity of the target.

As mentioned before, the cross section attributed to the liner 11 and perpendicular to a lengthwise direction of the liner 11 is of a tall V-shape conducive to further enhancement of the focusing of blast energy of the liquid. The liquid disruptor device 100 displays sufficient flexibility to fit tightly around explosives which come in cylindrical, spherical or irregular shapes, thereby dispensing with the need to provide any other fixing device for holding the liquid disruptor device and the explosives together. Furthermore, variable included angles between the arms 101 of the liquid disruptor device 100 enable the liquid disruptor device 100 to go around the obstacle O and thus fare well in various surroundings.

Therefore, the liquid disruptor devices 100 combine to form the liquid disruptor device modules 200, 300 of specific geometric shapes. The liquid disruptor device modules 200, 300 are effective in detonating large explosives and creating sufficiently large openings on the wall of a building or the hull of a ship for residents or passengers to escape in case of an accident or disaster.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A liquid disruptor device, comprising:

a front casing, comprising:

a liner formed by bending an upright plate lengthwise, backward;

an enclosing wall formed by extending an edge of the liner backward by a distance;

a front casing chamber defined by the liner and the enclosing wall and adapted to contain a liquid; and a front casing opening in communication with an outside of the front casing and the front casing chamber;

a liquid seal film for closing the front casing opening of the front casing;

a rear casing coupled to the front casing from behind, the rear casing comprising:

an outer casing wall;

an outer casing wall chamber defined by the outer casing wall and adapted to contain explosives and blowback weights;

an outer casing wall opening in communication with an outside of the rear casing and the outer casing wall chamber;

an inner casing wall disposed in the outer casing wall chamber;

an inner casing wall chamber defined by the inner casing wall and adapted to receive a detonator; and an inner casing wall opening in communication with an outside of the rear casing and the inner casing wall chamber;

a plane wave generator disposed between the front casing and the rear casing, the plane wave generator comprising:

a plate having a plate surface and a groove, with the groove disposed on the plate surface and adapted to contain the explosives; and a counter-impact cover, comprising:

a lid for closing the outer casing wall opening of the rear casing; and a through hole disposed on the lid to penetrate the lid and corresponding in position to the inner casing wall opening of the rear casing.

2. The liquid disruptor device of claim 1, wherein the front casing, the liquid seal film, the rear casing, the plane wave generator and the counter-impact cover are made of a flexible material.

3. The liquid disruptor device of claim 1, wherein a cross section attributed to the liner and perpendicular to a lengthwise direction of the liner is of a tall V-shape.

4. The liquid disruptor device of claim 1, wherein a cross section of the liquid disruptor device is of a specific radially-extending-shape and is defined by at least three arms.

5. The liquid disruptor device of claim 2, wherein a cross section of the liquid disruptor device is of a specific radially-extending-shape and is defined by at least three arms.

6. The liquid disruptor device of claim 3, wherein a cross section of the liquid disruptor device is of a specific radially-extending-shape and is defined by at least three arms.

7. The liquid disruptor device of claim 4, wherein included angles between the arms are variable.

8. The liquid disruptor device of claim 5, wherein included angles between the arms are variable.

9. The liquid disruptor device of claim 6, wherein included angles between the arms are variable.

10. A liquid disruptor device module, comprising at least two said liquid disruptor devices of claim 1.

11. The liquid disruptor device module of claim 10, wherein the liquid disruptor devices combine and thereby take on a geometric shape.

12. A method of manufacturing a liquid disruptor device, comprising the steps of:

(a) providing a front casing, the front casing comprising:

a liner formed by bending an upright plate lengthwise, backward;

an enclosing wall formed by extending an edge of the liner backward by a distance;

a front casing chamber defined by the liner and the enclosing wall; and a front casing opening in communication with an outside of the front casing and the front casing chamber;

(b) introducing a liquid into the front casing chamber of the front casing;

(c) providing a liquid seal film, followed by closing the front casing opening of the front casing with the liquid seal film;

(d) providing a plane wave generator, the plane wave generator comprising:

a plate having a plate surface and a groove, with the groove formed on the plate surface;

(e) placing explosives in the groove of the plane wave generator, following by placing the plane wave generator behind the front casing;

(f) providing a rear casing, the rear casing comprising:

an outer casing wall;

an outer casing wall chamber defined by the outer casing wall;

an outer casing wall opening in communication with an outside of the rear casing and the outer casing wall chamber;

an inner casing wall disposed in the outer casing wall chamber;

an inner casing wall chamber defined by the inner casing wall; and an inner casing wall opening in communication with an outside of the rear casing and the inner casing wall chamber;

(g) placing the explosives and blowback weights in the outer casing wall chamber of the rear casing;

(h) providing a counter-impact cover, the counter-impact cover comprising:

a lid; and a through hole formed on the lid to penetrate the lid;

(i) closing the outer casing wall opening of the rear casing with the lid of the counter-impact cover so that the through hole of the counter-impact cover corresponds in position to the inner casing wall opening of the rear casing;

(j) coupling the rear casing to the front casing from behind so that the plane wave generator is disposed between the front casing and the rear casing; and (k) inserting a detonator into the inner casing wall chamber of the rear casing.

13. The method of claim 12, wherein a cross section attributed to the liner and perpendicular to a lengthwise direction of the liner is of a tall V-shape.

14. The method of claim 12, wherein a cross section of the liquid disruptor device is of a specific radially-extending-shape and is defined by at least three arms.

* * * * *